US005209328A

United States Patent [19]

Kotkins, Jr.

[11] Patent Number: 5,209,328

[45] Date of Patent: May 11, 1993

[54] ROLLER-SUPPORTED TRAVELING LUGGAGE

[75] Inventor: Henry L. Kotkins, Jr., Seattle, Wash.

[73] Assignee: Skyway Luggage Company, Seattle, Wash.

[21] Appl. No.: 832,984

[22] Filed: Feb. 10, 1992

[51] Int. Cl.[5] ..... A45C 5/14; A45C 7/00

[52] U.S. Cl. ..... 190/18 A; 190/103; 190/111

[58] Field of Search ..... 190/18 A, 21, 108, 109, 190/110, 111, 112, 103

[56] References Cited

U.S. PATENT DOCUMENTS

| | | | |
|---|---|---|---|
| 752,756 | 2/1904 | Christie | 190/21 |
| 792,183 | 6/1905 | Tiderman | 190/21 |
| 830,396 | 9/1906 | Winter | 190/119 |
| 1,521,310 | 12/1924 | Moran | 190/108 |
| 3,437,181 | 4/1969 | Blount, Jr. | 190/111 |
| 5,054,589 | 10/1991 | Bomes et al. | 190/18 A |
| 5,109,961 | 5/1992 | Bergman | 190/18 A |

FOREIGN PATENT DOCUMENTS

| | | | |
|---|---|---|---|
| 766735 | 7/1934 | France | 190/112 |
| 1561960 | 4/1969 | France | 190/109 |
| 2454773 | 12/1980 | France | 190/18 A |
| 2641172 | 7/1990 | France | 190/18 A |

*Primary Examiner*—Gary E. Elkins
*Attorney, Agent, or Firm*—Seed and Berry

[57] ABSTRACT

A roller supported traveling luggage has a large central platform supported by wheels and having opposite side edges, in one embodiment, there are first and second cases joined at their laterally outer edges to the outer side edges of the platform. The cases can be held together by suitable fasteners and provide a very stable traveling luggage when the cases and platform are pulled or dragged along the ground. The bags when they are swung open have access openings on their inner walls for good accessibility to the contents of the bags. In a second embodiment, a single case is pivotally secured to an outer edge also to a laterally outer edge of the platform. The single case has an access opening in its bottom wall that is concealed when overlying the platform. The central platform may also have a central access opening and may be vertically expandable.

11 Claims, 2 Drawing Sheets

ROLLER-SUPPORTED TRAVELING LUGGAGE

DESCRIPTION

1. Field of the Invention

This invention relates to traveling luggage, and particularly luggage of the type which is supported on wheels and pulled along the ground or walkways.

2. Description of the Prior Art

Roller luggage is well known. This type of luggage has a vertical height generally much greater than its horizontal width. The pulling handle is then either a handle on the top of the case or a pulling cord or strap. This type of luggage is very popular but tends to be unstable particularly if the rollers strike a crack, or any other irregularity, in the supporting walkway.

Large duffel bags of the cylindrical and elongated shape have also been known to be supported by rollers. These types of bags have generally had a rigid roller support built into the bottom of the bag. The top of the bag has a handle and thus by tilting the duffel bag it is pulled along the walkway on its support rollers. The large duffel bag, however, is generally difficult to access as it generally has only one compartment accessible only through the top.

SUMMARY OF THE INVENTION

It is an object of this invention to provide a roller-supported traveling luggage which is more stable when being pulled along the walkway.

It is another object of this invention to provide roller-supported luggage that has a large amount of accessibility into the luggage and clothes-holding compartments of the luggage.

These objects are both obtained by providing an enlarged central platform having widely spaced casters or wheels thereon. Joined to the laterally outward side edges of the platform is at least one bag that may be pivoted outwardly about its outer edge to lie outwardly of the platform in an open position or be pivoted inwardly to overlie the platform in a closed position. In a second form of the invention, there are at least two bags that are pivoted each at an outer edge to the outer edge of the platform. When one or more of the bags are pivoted outwardly, that bag will lie outwardly of the platform. When pivoted inwardly, the bags will overlie the platform and be joined to one another.

Suitable securing members are provided for holding the bags in the closed position and suitable handles are provided for carrying and pulling the luggage.

In both forms of the invention, access openings into the bag or bags will be concealed when the bag or bags are over the platform. This will reduce the availability of unauthorized access into the bags and shield the access openings from inclimate weather.

In one form of the invention, the bags are soft panel bags having their outer edges sewn to the outer edges of the central platform. The access openings are in the inner walls of the bags so that they are enclosed and not readily accessible when the bag is in a closed position.

In one form of the invention, particularly with a single bag, the central platform is itself a compartment having an access opening. If desired the central panel can be made vertically expandable for increasing its storage capacity.

As is readily apparent, the bag or bags provide compartments for ready accessibility through their own access openings, yet when the bag or bags are closed and secured to the platform or to one another, the luggage is quite stable and virtually untippable. Thus the platform can be pulled rapidly along the walkway either with a separate pulling cord or by grasping the top handles of the bag or bags.

DETAILED DESCRIPTION OF THE INVENTION

Figure 1:
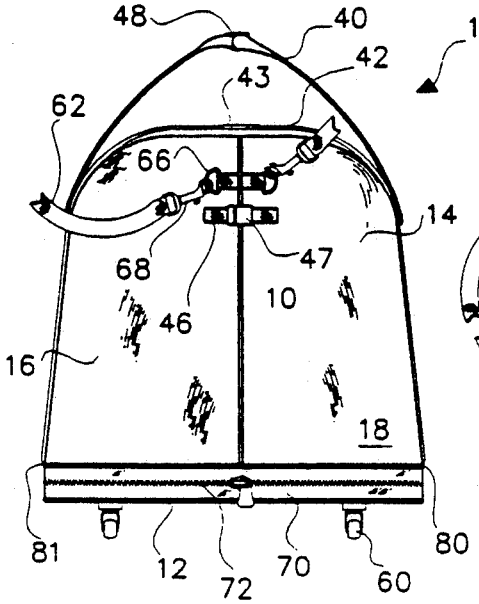
FIG. 1 is an end elevation of the luggage embodying the principle of the invention.

The luggage 10 includes a central platform 12. In one embodiment, there is a right-side bag or case 14 and a left-side bag or case 16. Each case preferably is provided with a soft, flexible end panel 18, a soft, flexible outer side panel 20, a soft, flexible inner side panel 22, and a rear soft, flexible panel 24. The panels could be rigid, however.

Preferably, the inner side panels 22 are provided with access openings 26 closed by zippers 28. As is well known, the pulls 30 of the zippers can be locked together by a combination or key lock 32 as is well known.

Each side case has a lifting handle 40, a set of top tie straps 42 joined in a conventional manner by fasteners or clasps 43. Each bag also has a side tie strap 46 joined by a conventional releasable fastener or clasp 47.

The handles 40 can be joined together by a Velcro cuff 48 as is well known. The bags can also be locked together if desired.

Figure 3:
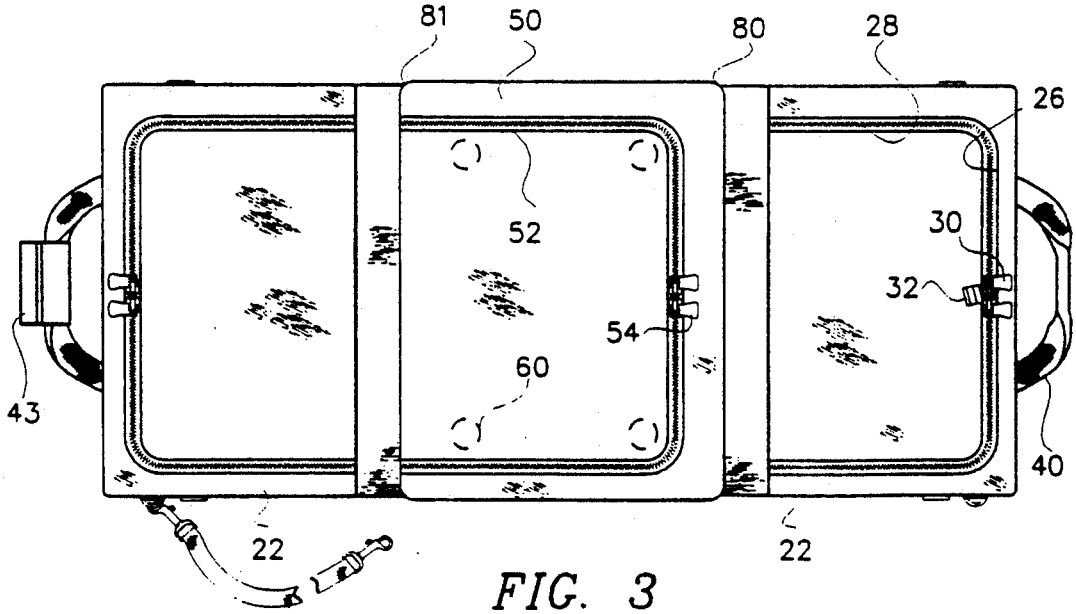
FIG. 3 is a plan view of the luggage with the side bags hinged outwardly to their open position.
Figure 4:
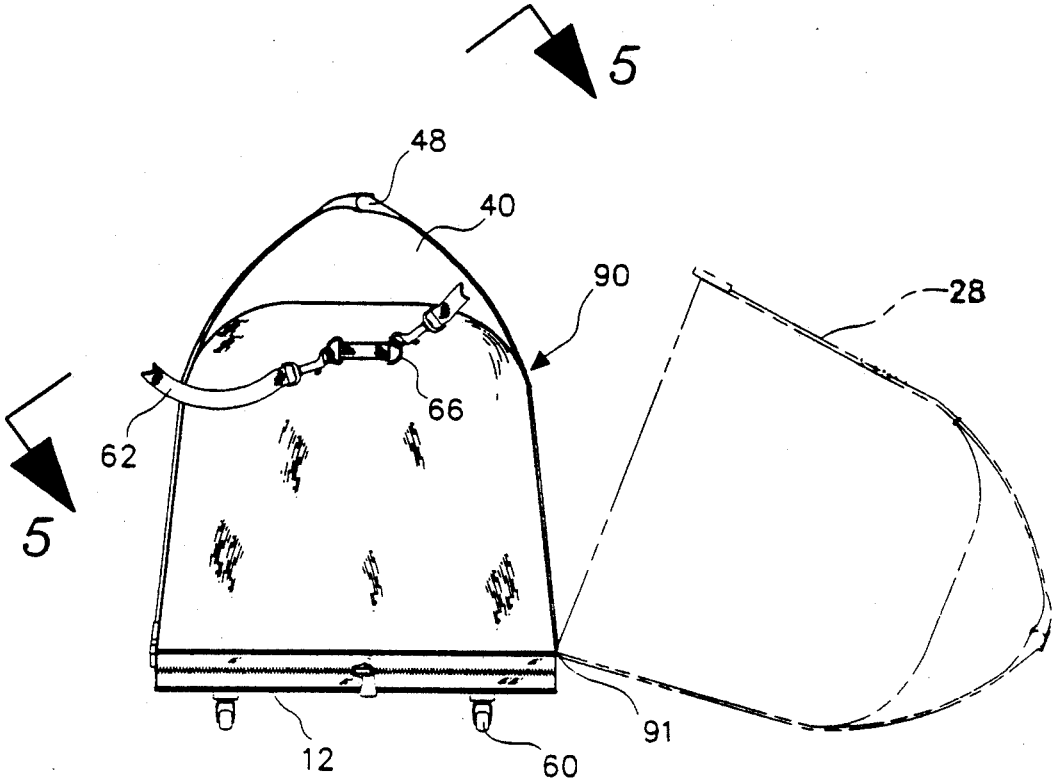
FIG. 4 is an end elevation of the luggage embodying a single bag.
Figure 5:
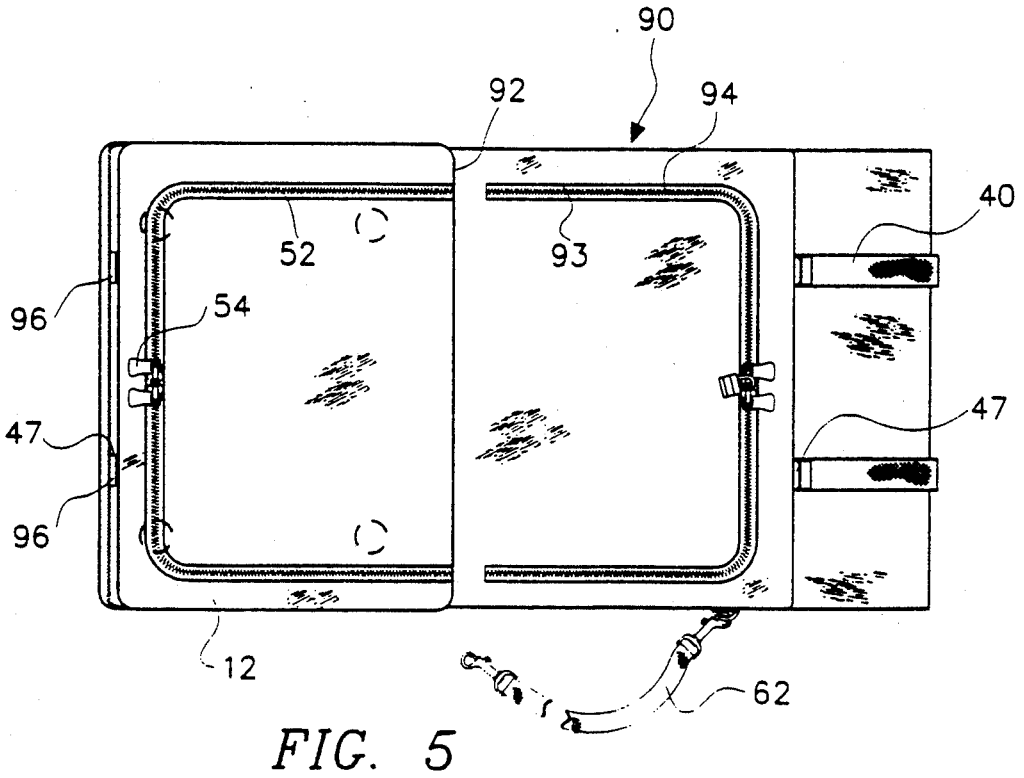
FIG. 5 is an isometric taken in the direction of the arrows 5—5 of FIG. 4 with the bag tilted outwardly as shown in phantom lines 4 in FIG. 4.

As best shown in FIGS. 4 and 5, only a single bag 90 having an outer edge 91 sewn or otherwise hinged to the outer edge 92 of the platform 12 may be employed. In this embodiment, an access opening 93 closed by a zipper 94 is also provided and will be unaccessible to unauthorized entry when the bag is secured over the platform as in FIG. 4. The bag also has a pull strap 62, lifting handles 40 with a Velcro cuff 48 as in the embodiment of FIGS. 1-3. In addition, the handles 40 on the side of the bag 90 remote from edge 92 are joined to spaced straps 96 having conventional hook fasteners or clasps 47 to secure the bag to the platform when lifting or pulling the bag.

Preferably the central platform 12 of both embodiments has a rigid bottom and a soft upper panel 50 having an access opening closed by a zipper 52. The zipper has pulls 54 to close the access opening.

The platform is supported by conventional, removable casters or wheels 60. As is best shown in FIGS. 3 and 5, the wheels are shown in phantom and can be seen to be quite widely spaced both in the fore-and-aft direction and in the sideways direction. This wide spacing of the wheels gives the luggage good stability against tipping.

The luggage can be pulled either by grasping the handle 40 or by connecting a releasable pull cord 62 to rings 66 on the bag or bags using conventional snaps 68.

In one form of the invention, the platform has soft front, rear and side panels 70 which can be expanded by opening a zipper 72 which completely encircles the platform panels. Expandable zippers are well known and need not be further described. It is sufficient to state that the lower compartment, if desired, may be left compact or may be expanded vertically by opening the zipper 72 making room in the bottom platform for soiled clothing, shoes, or the like.

Figure 2:
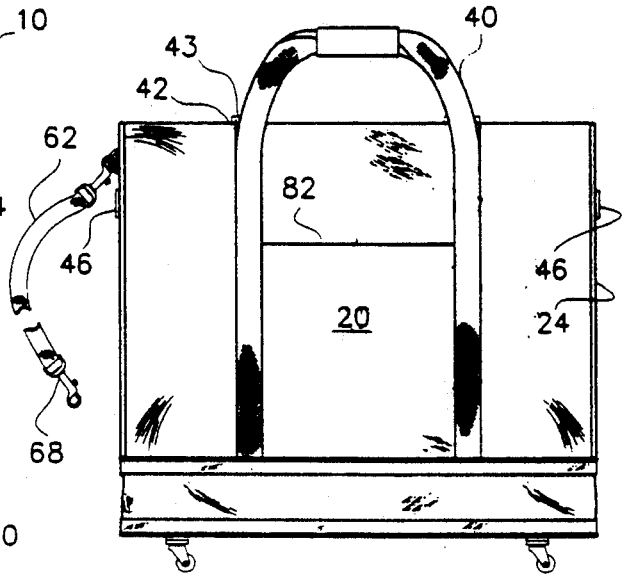
FIG. 2 is a side elevation of the luggage.

In use the bags are shown as in FIGS. 1 and 2 with the side straps, top straps and cuff 48 holding the two bags tightly together in a unitary fashion. Similarly, the bag in FIGS. 4 and 5 is shown fastened over the platform. In this manner, the luggage is easy to carry or pull and is quite stable.

When it is desired to access a bag, however, the fasteners or clasps are released, allowing the bag or bags to tip or be folded outwardly along the hinge line 92 or 80 and 81. This exposes the access openings in the bags and the access opening 52 in the central platform if one is provided. The access openings and the separation of the bags from the platforms provides optimum accessibility to the contents of the bags, allowing for great flexibility of storing of the clothing within the bags.

While the preferred embodiments of the invention have been illustrated and described, it should be understood that variations will be apparent to those skilled in the art. For example, more than one bag can be attached to the platform and the bags can be permanently attached or releasably attached as by zippers and the like. Also, a pouch 82 can be provided on an outer side panel as shown. Accordingly, the invention is not to be limited to the specific embodiments illustrated in the drawings.

What is claimed is:

1. Roller-supported traveling luggage comprising:

a central platform having front, rear, and opposite side edges, a bottom wall, top wall and side walls, the side walls of the central platform being expandable and having a zipper circumscribing the side walls of the central platform for expanding and contracting the side walls, rollers supporting the platform;

first and second cases each having a bottom panel, front and rear end panels, an inner side panel, and an outer side panel, each outer side panel having a lower outer edge hingedly joined to an opposite side edge of the central platform;

the inner side panels of each of the first and second cases opposed to one another in a case closed position and spaced outwardly from one another in a case open position; and means for joining the cases together into a unitary unit when in the case closed position.

2. Roller-supported traveling luggage comprising:

a central platform having front, rear, and opposite side edges, rollers supporting the platform;

first and second cases each having a bottom panel, front and rear end panels, an inner side panel, and an outer side panel, each outer side panel having a lower outer edge hingedly joined to an opposite side edge of the central platform and each inner side panel having an access opening and a closure means for closing the access opening;

the panels of the cases are soft and flexible;

the inner side panels of each of the first and second cases opposed to one another in a case closed position and spaced outwardly from one another in a case open position; and means for joining the cases together into a unitary unit when in the case closed position.

3. A wheeled carrying luggage having a horizontal platform, wheels supporting the platform, at least two cases pivotally joined to the platform at opposite laterally outward edges of the platform so that the cases can be pivoted outwardly to lie laterally outward of the platform when in an open position, and in abutting relation over the platform when in a closed position, each case having a bottom wall, an outer wall and an inner wall, the inner walls of the cases abutting one another when the cases are pivoted inwardly to overlie the platform, an access opening in each inner wall of each case, the access openings being concealed when the cases are abutting one another, and means for pulling the platform along a floor.

4. The luggage of claim 3, including fastener members for connecting the two cases and platform together into a unitary package.

5. The luggage of claim 3, the horizontal platform including a storage compartment having an upper wall and an access opening located in the upper wall of the storage compartment.

6. A wheeled carrying luggage having a horizontal platform, wheels supporting the platform, at least one case joined to the platform only at a laterally outward edge so that the case can be pivoted outwardly to lie laterally outward of the platform when in an open position, and in abutting relation over the platform when in a closed position, the case including an access opening that is concealed when the case is overlying and abutting the platform, wherein the case is of a soft flexible material, and means for pulling the platform along a floor.

7. A wheeled carrying luggage having a horizontal platform, wheels supporting the platform, at least one case joined tot he platform only at a laterally outward edge so that the case can be pivoted outwardly to lie laterally outward of the platform when in an open position, and in abutting relation over the platform when in a closed position, the case including a bottom wall provided with a first access opening that is concealed when the case is overlying and abutting the platform, the platform having a storage compartment and an upper wall provided with a second access opening, wherein the first and second access openings are both concealed when the case is pivoted inwardly to overlie the platform, and means for pulling the platform along a floor.

8. Roller-supported traveling luggage comprising:

a central platform having front, rear, and opposite side edges, rollers supporting the platform;

first and second cases made of a flexible material each having a bottom panel, front and rear end panels, an inner side panel, and an outer side panel, each outer side panel having a lower outer edge hingedly joined to an opposite side edge of the central platform;

the inner side panels of each of the first and second cases opposed to one another in a case closed position and spaced outwardly from one another in a case open position;

each of the bottom panels being no longer than the central platform such that the bottom panels are fully supported by the central platform; and means for joining the cases together into a unitary unit when in the case closed position.

9. Roller-supported travelling luggage comprising:

a central platform having a lower panel provided with front, rear, and opposite side edges, an upper panel provided with front, rear, and opposite side edges and an access opening, the central platform further having flexible front, rear, and side panels coupled to the edges of the upper panel and to the edges of the lower panel, rollers supporting the platform;

first and second cases each having a bottom panel, front and rear end panels, an inner side panel, and an outer side panel, each outer side panel having a lower outer edge hindgely joined to an opposite side edge of the upper panel of the central platform such that the central platform is vertically expandable;

the inner side panels of each of the first and second cases opposed to one another in a case closed position and spaced outwardly from one another in a case open position; and means for joining the cases together into a unitary unit when in the case closed position.

10. The luggage of claim 9 wherein the end and side panels of the cases are flexible.

11. A wheeled carrying luggage comprising a horizontal platform having an upper panel and a lower panel, the upper panel being vertically expandable in a direction away from the lower panel, wheels supporting the platform, at last one case made of a flexible material joined to the platform only at a laterally outward edge of the upper panel of the platform so that the case can be pivoted outwardly to lie laterally outward of eh platform when in an open position, and in abutting relation over the platform when in a closed position, the case being no longer than the horizontal platform such that the case is fully supported by the horizontal platform and the case including an access opening that is concealed when the case is overlying and abutting the platform, and means for pulling the platform along a floor.

* * * * *

UNITED STATES PATENT AND TRADEMARK OFFICE

CERTIFICATE OF CORRECTION

PATENT NO. : 5,209,328

DATED : May 11, 1993

INVENTOR(S) : Henry L. Kotkins, Jr.

It is certified that error appears in the above-identified patent and that said Letters Patent is hereby corrected as shown below:

In column 4, claim 7, line 39, please delete "tot he" and substitute therefor --to the--.

In column 5, claim 9, line 13, please delete "hindgely" and substitute therefor --hingedly--.

In column 6, claim 11, line 12, please delete "eh" and substitute therefor --the--.

Signed and Sealed this

Eleventh Day of January, 1994

Bruce Lehman

*Attest:*

BRUCE LEHMAN

*Attesting Officer*

*Commissioner of Patents and Trademarks*